US007784160B2

(12) United States Patent
Dais et al.

(10) Patent No.: US 7,784,160 B2
(45) Date of Patent: Aug. 31, 2010

(54) POUCH AND AIRTIGHT RESEALABLE CLOSURE MECHANISM THEREFOR

(75) Inventors: Brian C. Dais, Saginaw, MI (US); Robert R. Turvey, Sanford, MI (US); James C. Pawloski, Bay City, MI (US); Bryan L. Ackerman, Freeland, MI (US); Daniel P. Zimmerman, Livonia, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 600 days.

(21) Appl. No.: 11/818,593

(22) Filed: Jun. 15, 2007

(65) Prior Publication Data

US 2008/0226203 A1 Sep. 18, 2008

Related U.S. Application Data

(63) Continuation-in-part of application No. 11/725,120, filed on Mar. 16, 2007.

(51) Int. Cl.
*A44B 18/00* (2006.01)

(52) U.S. Cl. ..... 24/585.12; 383/63

(58) Field of Classification Search ..... None
See application file for complete search history.

(56) References Cited

U.S. PATENT DOCUMENTS

| | | | |
|---|---|---|---|
| 2,576,322 | A | 11/1951 | Waters |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |
| 2,927,722 | A | 3/1960 | Metzger |
| 2,960,144 | A | 11/1960 | Graf |
| 3,026,231 | A | 3/1962 | Chavannes |
| 3,060,985 | A | 10/1962 | Vance et al. |
| 3,098,563 | A | 7/1963 | Skees |
| 3,102,676 | A | 9/1963 | Danelli et al. |

(Continued)

FOREIGN PATENT DOCUMENTS

| | | |
|---|---|---|
| JP | 3294043 | 5/2002 |

*Primary Examiner*—Jack W. Lavinder

(57) ABSTRACT

A pouch has an airtight elongate closure mechanism adapted to provide vacuum retention within an interior of the pouch over an extended period of time when sealed. The closure mechanism includes a first pair of interlocking members that resealably mate together, a second pair of interlocking members that resealably mate together, and sealing members that form an air tight seal disposed between the first and second pairs of interlocking members. The closure elements may be connected with opposing sidewalls of the pouch in a manner designed to provide differential opening and closing forces. The pouch may also include a check valve and air evacuation channels to aid in evacuating air from the interior.

5 Claims, 7 Drawing Sheets

U.S. PATENT DOCUMENTS

| | | | |
|---|---|---|---|
| 3,113,715 | A | 12/1963 | Pangrac |
| 3,141,221 | A | 7/1964 | Faulls, Jr. |
| 3,142,599 | A | 7/1964 | Chavannes |
| 3,149,772 | A | 9/1964 | Olsson |
| 3,160,323 | A | 12/1964 | Weisberg |
| 3,216,172 | A | 11/1965 | Piazze |
| 3,219,084 | A | 11/1965 | Ausnit et al. |
| 3,224,574 | A | 12/1965 | McConnell |
| 3,237,844 | A | 3/1966 | Hughes |
| 3,251,463 | A | 5/1966 | Bodet |
| 3,302,859 | A | 2/1967 | Perry |
| 3,325,084 | A | 6/1967 | Ausnit |
| 3,372,442 | A | 3/1968 | Ishimatsu |
| 3,381,887 | A | 5/1968 | Lowry |
| 3,389,733 | A | 6/1968 | Siegel |
| 3,411,698 | A | 11/1968 | Reynolds |
| 3,440,696 | A | 4/1969 | Staller |
| 3,464,094 | A | 9/1969 | Mates |
| 3,516,217 | A | 6/1970 | Gildersleeve |
| 3,557,413 | A | 1/1971 | Engle |
| 3,565,147 | A | 2/1971 | Ausnit |
| 3,575,781 | A | 4/1971 | Pezely |
| 3,595,467 | A | 7/1971 | Goglio |
| 3,595,722 | A | 7/1971 | Dawbarn |
| 3,608,439 | A | 9/1971 | Ausnit |
| 3,628,720 | A | 12/1971 | Schmedding |
| 3,633,642 | A | 1/1972 | Siegel |
| 3,655,501 | A | 4/1972 | Tesch |
| 3,679,511 | A | 7/1972 | Ausnit |
| 3,746,215 | A | 7/1973 | Ausnit et al. |
| 3,780,781 | A | 12/1973 | Uramoto |
| 3,790,992 | A | 2/1974 | Herz |
| 3,799,427 | A | 3/1974 | Goglio |
| 3,809,217 | A | 5/1974 | Harrison |
| 3,833,166 | A | 9/1974 | Murray |
| 3,918,131 | A | 11/1975 | Ausnit |
| 3,937,396 | A | 2/1976 | Schneider |
| 3,980,226 | A | 9/1976 | Franz |
| 3,989,182 | A | 11/1976 | Stearley |
| 4,000,846 | A | 1/1977 | Gilbert |
| 4,020,884 | A | 5/1977 | Jadot |
| 4,085,886 | A | 4/1978 | Nishioka |
| 4,101,355 | A | 7/1978 | Ausnit |
| 4,105,491 | A | 8/1978 | Haase et al. |
| 4,122,993 | A | 10/1978 | Glas |
| 4,134,535 | A | 1/1979 | Barthels et al. |
| 4,155,453 | A | 5/1979 | Ono |
| 4,186,786 | A | 2/1980 | Kirkpatrick |
| 4,206,870 | A | 6/1980 | DeVries |
| 4,212,337 | A | 7/1980 | Kamp |
| 4,215,725 | A | 8/1980 | Callet et al. |
| 4,246,288 | A | 1/1981 | Sanborn, Jr. |
| 4,310,118 | A | 1/1982 | Kisida et al. |
| 4,332,344 | A | 6/1982 | Strodthoff |
| 4,340,558 | A | 7/1982 | Hendrickson |
| 4,354,541 | A | 10/1982 | Tilman |
| 4,355,494 | A | 10/1982 | Tilman |
| 4,363,345 | A | 12/1982 | Scheibner |
| 4,372,921 | A | 2/1983 | Sanderson et al. |
| 4,426,816 | A | 1/1984 | Dean et al. |
| 4,430,070 | A | 2/1984 | Ausnit |
| 4,449,243 | A | 5/1984 | Platel |
| 4,470,153 | A | 9/1984 | Kenan |
| 4,491,959 | A | 1/1985 | Loefberg |
| 4,509,642 | A | 4/1985 | Rowell |
| 4,524,460 | A | 6/1985 | Twiehoff et al. |
| 4,528,224 | A | 7/1985 | Ausnit |
| 4,532,652 | A | 7/1985 | Herrington |
| 4,541,117 | A | 9/1985 | Ashbeck |
| 4,550,546 | A | 11/1985 | Raley et al. |
| 4,551,379 | A | 11/1985 | Kerr |
| 4,566,131 | A | 1/1986 | Achelpohl |
| 4,576,283 | A | 3/1986 | Fafournoux |
| 4,578,813 | A | 3/1986 | Ausnit |
| 4,581,764 | A | 4/1986 | Plock et al. |
| 4,653,661 | A | 3/1987 | Buchner et al. |
| 4,660,355 | A | 4/1987 | Kristen |
| 4,672,684 | A | 6/1987 | Barnes et al. |
| 4,691,372 | A | 9/1987 | Van Erden |
| 4,691,373 | A | 9/1987 | Ausnit |
| 4,701,358 | A | 10/1987 | Behr et al. |
| 4,702,376 | A | 10/1987 | Pagliaro |
| 4,712,574 | A | 12/1987 | Perrott |
| 4,715,494 | A | 12/1987 | Heitzenroder et al. |
| 4,730,635 | A | 3/1988 | Linden |
| 4,731,911 | A | 3/1988 | Gould |
| 4,736,450 | A | 4/1988 | Van Erden et al. |
| 4,736,451 | A | 4/1988 | Ausnit |
| 4,747,702 | A | 5/1988 | Scheibner |
| 4,752,992 | A | 6/1988 | Kondo et al. |
| 4,756,628 | A | 7/1988 | Branson |
| 4,756,629 | A | 7/1988 | Tilman et al. |
| 4,778,282 | A | 10/1988 | Borchardt et al. |
| 4,780,937 | A | 11/1988 | Kusayama |
| 4,787,754 | A | 11/1988 | Herrington |
| 4,787,755 | A | 11/1988 | Branson |
| 4,787,880 | A | 11/1988 | Ausnit |
| 4,791,710 | A | 12/1988 | Nocek et al. |
| 4,792,240 | A | 12/1988 | Ausnit |
| 4,795,269 | A | 1/1989 | Scheibner |
| 4,796,300 | A | 1/1989 | Branson |
| 4,807,300 | A | 2/1989 | Ausnit et al. |
| 4,812,056 | A | 3/1989 | Zieke |
| 4,812,074 | A | 3/1989 | Ausnit et al. |
| 4,817,188 | A | 3/1989 | Van Erden |
| 4,825,514 | A | 5/1989 | Akeno |
| 4,829,641 | A | 5/1989 | Williams |
| 4,832,505 | A | 5/1989 | Ausnit et al. |
| 4,834,554 | A | 5/1989 | Stetler, Jr. et al. |
| 4,840,611 | A | 6/1989 | Van Erden et al. |
| 4,841,603 | A | 6/1989 | Ragni |
| 4,858,286 | A | 8/1989 | Siegel |
| 4,859,259 | A | 8/1989 | Scheibner |
| 4,863,286 | A | 9/1989 | Branson |
| 4,869,725 | A | 9/1989 | Schneider et al. |
| 4,875,259 | A | 10/1989 | Appeldorn |
| 4,877,334 | A | 10/1989 | Cope |
| 4,878,763 | A | 11/1989 | Ausnit |
| 4,890,637 | A | 1/1990 | Lamparter |
| 4,890,935 | A | 1/1990 | Ausnit et al. |
| 4,892,414 | A | 1/1990 | Ausnit |
| 4,903,718 | A | 2/1990 | Sullivan |
| 4,907,321 | A | 3/1990 | Williams |
| 4,909,017 | A | 3/1990 | McMahon et al. |
| 4,923,701 | A | 5/1990 | VanErden |
| 4,925,318 | A | 5/1990 | Sorensen |
| 4,928,829 | A | 5/1990 | Di Bernardo |
| 4,929,487 | A | 5/1990 | Tilman et al. |
| 4,930,904 | A | 6/1990 | Gröner et al. |
| 4,947,525 | A | 8/1990 | Van Erden |
| 4,953,708 | A | 9/1990 | Beer et al. |
| 4,961,944 | A | 10/1990 | Matoba et al. |
| 4,964,739 | A | 10/1990 | Branson et al. |
| 4,966,470 | A | 10/1990 | Thompson et al. |
| 4,985,192 | A | 1/1991 | Roeder et al. |
| 5,007,143 | A | 4/1991 | Herrington |
| 5,009,318 | A | 4/1991 | Lepinoy |
| 5,012,561 | A | 5/1991 | Porchia et al. |
| 5,017,021 | A | 5/1991 | Simonsen et al. |
| 5,022,530 | A | 6/1991 | Zieke |
| RE33,674 | E | 8/1991 | Uramoto |
| 5,037,138 | A | 8/1991 | McClintock et al. |
| 5,044,774 | A | 9/1991 | Bullard et al. |
| 5,053,091 | A | 10/1991 | Giljam et al. |

5,056,933 A 10/1991 Kamp
5,059,036 A 10/1991 Richison et al.
5,067,208 A 11/1991 Herrington, Jr. et al.
5,067,822 A 11/1991 Wirth et al.
5,070,584 A 12/1991 Dais et al.
5,088,162 A 2/1992 Allan
5,088,971 A 2/1992 Herrington
5,092,684 A 3/1992 Weeks
5,119,531 A 6/1992 Berger et al.
5,140,727 A 8/1992 Dais et al.
5,140,796 A 8/1992 Pope
5,141,577 A 8/1992 Porchia et al.
5,142,970 A 9/1992 ErkenBrack
5,167,454 A 12/1992 Woods et al.
5,168,586 A 12/1992 Small
5,170,990 A 12/1992 Kamiya et al.
5,174,658 A 12/1992 Cook et al.
5,179,767 A 1/1993 Allan
5,186,543 A 2/1993 Cochran
5,188,461 A 2/1993 Sorensen
5,189,764 A 3/1993 Herrington et al.
5,192,135 A 3/1993 Woods et al.
5,198,055 A 3/1993 Wirth et al.
5,203,458 A 4/1993 Cornwell
5,209,264 A 5/1993 Koyanagi
5,209,574 A 5/1993 Tilman
5,211,481 A 5/1993 Tilman
5,212,855 A 5/1993 McGanty
5,216,787 A 6/1993 Custer et al.
5,228,271 A 7/1993 Wallace
5,235,731 A 8/1993 Anzai et al.
5,238,306 A 8/1993 Heintz et al.
5,240,112 A 8/1993 Newburger
5,242,516 A 9/1993 Custer et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,263,777 A 11/1993 Domke
5,272,794 A 12/1993 Hamatani et al.
5,283,932 A 2/1994 Richardson et al.
RE34,554 E 3/1994 Ausnit
5,293,672 A 3/1994 Tominaga et al.
5,301,394 A 4/1994 Richardson et al.
5,301,395 A 4/1994 Richardson et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,351,369 A 10/1994 Swain
5,351,828 A 10/1994 Becker et al.
5,354,133 A 10/1994 Rapparini
5,356,222 A 10/1994 Kettner et al.
5,366,294 A 11/1994 Wirth et al.
5,368,394 A 11/1994 Scott et al.
5,369,847 A 12/1994 Naya et al.
5,371,925 A 12/1994 Sawatsky
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.
5,448,807 A 9/1995 Herrington, Jr.
5,450,963 A 9/1995 Carson
5,462,473 A 10/1995 Sheller
5,469,966 A 11/1995 Boyer
5,480,030 A 1/1996 Sweeney et al.
5,492,241 A 2/1996 Barnett et al.
5,494,165 A 2/1996 Detrick
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka
5,540,557 A 7/1996 Carson
5,542,902 A 8/1996 Richison et al.
5,544,752 A 8/1996 Cox
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,566,429 A 10/1996 Martinez et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,699,838 A 12/1997 Catallo et al.
5,700,091 A 12/1997 Tanaka et al.
5,701,996 A 12/1997 Goto et al.
5,709,479 A 1/1998 Bell
5,713,669 A 2/1998 Thomas et al.
5,718,024 A 2/1998 Robbins
5,729,876 A 3/1998 Johnson
5,735,317 A 4/1998 Wu
5,735,395 A 4/1998 Lo
5,749,493 A 5/1998 Boone et al.
5,749,658 A 5/1998 Kettner
5,769,772 A 6/1998 Wiley
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,791,783 A 8/1998 Porchia et al.
5,794,315 A 8/1998 Crabtree et al.
5,827,163 A 10/1998 Kettner
5,829,884 A 11/1998 Yeager
5,833,791 A 11/1998 Bryniarski et al.
5,839,582 A 11/1998 Strong et al.
5,839,831 A 11/1998 Mazzocchi
5,839,832 A 11/1998 Hagino
5,855,498 A 1/1999 Spector
5,871,281 A 2/1999 Stolmeier et al.
5,874,155 A 2/1999 Gehrke et al.
5,875,611 A 3/1999 Plourde
5,881,881 A 3/1999 Carrington 5,882,120 A 3/1999 Bell
5,893,461 A 4/1999 Walters
5,893,645 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,967,664 A 10/1999 Giles et al.
5,983,466 A 11/1999 Petkovsek
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager
6,021,624 A 2/2000 Richison et al.
6,023,914 A 2/2000 Richison et al.
6,029,810 A 2/2000 Chen
6,030,122 A 2/2000 Ramsey et al.
6,033,113 A 3/2000 Anderson
6,039,182 A 3/2000 Light
6,044,621 A 4/2000 Malin et al.
6,045,264 A 4/2000 Miniea
6,045,546 A 4/2000 Drago et al.
6,047,450 A 4/2000 Machacek et al.
6,056,439 A 5/2000 Graham
6,059,456 A 5/2000 May
6,059,457 A 5/2000 Sprehe et al.
6,068,898 A 5/2000 Oyama
6,070,397 A 6/2000 Bachhuber
6,070,728 A 6/2000 Overby et al.
6,071,011 A 6/2000 Thomas et al.
6,074,096 A 6/2000 Tilman
6,076,967 A 6/2000 Beaudette
6,080,252 A 6/2000 Plourde
6,082,897 A 7/2000 Galomb
6,085,906 A 7/2000 Lambert
6,085,922 A 7/2000 Esser
6,092,931 A 7/2000 Tilman
6,110,586 A 8/2000 Johnson
6,112,374 A 9/2000 Van Erden
6,116,781 A 9/2000 Skeens
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,148,588 A 11/2000 Thomas et al.
6,149,302 A 11/2000 Taheri
6,149,304 A 11/2000 Hamilton et al.
6,152,601 A 11/2000 Johnson
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,202,849 B1 3/2001 Graham
6,209,287 B1 4/2001 Thieman
6,217,216 B1 4/2001 Taheri
6,220,754 B1 4/2001 Stiglic et al.
6,224,262 B1 5/2001 Hogan et al.
6,227,706 B1 5/2001 Tran
6,231,236 B1 5/2001 Tilman
6,240,941 B1 6/2001 Small et al.
6,244,021 B1 6/2001 Ausnit et al.
6,244,748 B1 6/2001 Kasai et al.
6,257,763 B1 7/2001 Stolmeier et al.
6,270,257 B1 8/2001 Yeager
6,273,609 B1 8/2001 Johnson
6,274,181 B1 8/2001 Richison et al.
6,279,298 B1 8/2001 Thomas et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,299,353 B1 10/2001 Piechocki et al.
6,299,720 B1 10/2001 Van Erden
6,317,939 B1 11/2001 Malin
6,321,423 B1 11/2001 Johnson
6,334,711 B1 1/2002 Risgalla et al.
6,345,911 B1 2/2002 Young et al.
6,347,437 B2 2/2002 Provan et al.
6,354,738 B1 3/2002 Buckman et al.
6,357,915 B2 3/2002 Anderson
6,361,209 B1 3/2002 LaRue et al.
6,361,211 B1 3/2002 Tilman
6,361,212 B1 3/2002 Sprehe et al.
6,364,530 B1 4/2002 Buchman
6,371,643 B2 4/2002 Saad et al.
6,371,644 B1 4/2002 Forman
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,402,375 B1 6/2002 Schreiter et al.
6,403,174 B1 6/2002 Copeta
6,408,872 B1 6/2002 Skeens et al.
6,439,771 B1 8/2002 Herrington, Jr.
6,450,686 B1 9/2002 May
6,461,042 B1 10/2002 Tomic et al.
6,468,332 B2 10/2002 Goglio et al.
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.

6,499,878 B1 12/2002 Dobreski et al.
6,499,879 B2 12/2002 Schneck
6,505,383 B2 1/2003 Machacek et al.
6,513,659 B1 2/2003 Ogura et al.
6,517,242 B1 2/2003 Buchman
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,965 B2 4/2003 Shaffer et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,604,634 B2 8/2003 Su
6,609,353 B1 8/2003 McMahon et al.
6,609,827 B2 8/2003 Bois et al.
6,611,996 B2 9/2003 Blythe et al.
6,622,857 B2 9/2003 Ohtsubo et al.
6,632,021 B2 10/2003 Bois et al.
6,634,384 B2 10/2003 Skeens et al.
6,637,939 B2 10/2003 Huffer
6,659,643 B2 12/2003 Plourde et al.
6,662,827 B1 12/2003 Clougherty et al.
6,663,284 B2 12/2003 Buckingham et al.
6,666,580 B2 12/2003 Bois
6,675,982 B2 1/2004 Heil et al.
6,679,027 B2 1/2004 Schreiter
6,691,383 B2 2/2004 Linton
6,692,147 B2 2/2004 Nelson
6,694,704 B1 2/2004 Ausnit
6,698,925 B2 3/2004 Bentsen
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,755,568 B2 6/2004 Malone et al.
6,767,131 B2 7/2004 Taheri
6,773,163 B2 8/2004 Ichikawa et al.
6,780,146 B2 8/2004 Thomas et al.
6,786,641 B2 9/2004 Plourde
6,789,690 B2 9/2004 Nieh et al.
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,826,808 B2 12/2004 Kutschka
6,827,105 B1 12/2004 Marble et al.
6,827,492 B2 12/2004 Cook
6,830,377 B2 12/2004 Schneider
6,835,257 B2 12/2004 Perrine
6,837,268 B2 1/2005 Skeens et al.
6,845,598 B1 1/2005 Melchoir
6,846,107 B2 1/2005 Sweeney et al.
6,851,248 B2 2/2005 Knight et al.
6,854,886 B2 * 2/2005 Piechocki et al. ..... 383/59
6,862,980 B2 3/2005 Heil et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,901,637 B2 6/2005 Machacek
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,945,392 B2 9/2005 Furukawa et al.
6,954,969 B1 10/2005 Sprehe
6,955,465 B2 10/2005 Machacek et al.
6,964,519 B2 11/2005 ErkenBrack
6,974,256 B2 12/2005 Kinigakis et al.
6,976,669 B2 12/2005 Van Zijll Langhout et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,004,209 B2 2/2006 Davis et al.
7,004,632 B2 2/2006 Hamilton et al.
7,011,615 B2 3/2006 Price et al.
7,022,058 B2 4/2006 Lee
7,036,988 B2 5/2006 Olechowski
7,048,136 B2 5/2006 Havens et al.
7,051,762 B2 5/2006 Haamer
7,077,570 B2 7/2006 Fukumori et al.
7,087,130 B2 8/2006 Wu et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,162,779 B2 1/2007 MacHacek
7,163,338 B2 1/2007 McCracken et al.
7,178,555 B2 2/2007 Engel et al.
2001/0034999 A1 11/2001 Xiong et al.
2002/0090151 A1 7/2002 Skeens et al.
2002/0097923 A1 7/2002 Dobreski et al.
2002/0124471 A1 9/2002 Anderson et al.
2002/0168118 A1 11/2002 Price
2002/0168119 A1 11/2002 Herrington, Jr.
2003/0016887 A1 1/2003 Su
2003/0024847 A1 2/2003 Malaspina
2003/0053722 A1 3/2003 Eggermont
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0219174 A1 11/2003 Piechocki
2003/0219177 A1 11/2003 Salvaro
2003/0223654 A1 12/2003 Gerrits
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.

2004/0114837 A1 6/2004 Koyanagi
2004/0136617 A1 7/2004 Gerrits
2004/0136618 A1 7/2004 Ausnit et al.
2004/0165794 A1 8/2004 Plourde et al.
2004/0177595 A1 9/2004 Kozak
2004/0208400 A1 10/2004 Linneweil
2004/0211698 A1 10/2004 Mak
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037164 A1 2/2005 Wu et al.
2005/0061812 A1 3/2005 Vilalta et al.
2005/0063620 A1 3/2005 Anderson
2005/0065007 A1 3/2005 Wu et al.
2005/0069229 A1 3/2005 McCracken et al.
2005/0103798 A1 5/2005 Luigi
2005/0135710 A1 6/2005 Melchoir
2005/0147330 A1 7/2005 Lee
2005/0172577 A1 8/2005 Oltrogge
2005/0190995 A1 9/2005 Koyanagi
2005/0196076 A1 9/2005 Tanaka et al.
2005/0205455 A1 9/2005 Harrison
2005/0220373 A1 10/2005 Wu
2005/0220374 A1 10/2005 Thomas et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.
2005/0281493 A1 12/2005 Heinemeier et al.
2005/0281494 A1 12/2005 Allen et al.
2005/0282695 A1 12/2005 Yeager
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2005/0286813 A1 12/2005 Borchardt
2005/0286817 A1 12/2005 Hall et al.
2006/0008185 A1 1/2006 Borchardt
2006/0008187 A1 1/2006 Armstrong
2006/0013514 A1 1/2006 Wu
2006/0029299 A1 2/2006 Share et al.
2006/0030472 A1 2/2006 Hartman et al.
2006/0034551 A1 2/2006 Linneweil
2006/0035777 A1 2/2006 Johnson
2006/0048483 A1 3/2006 Tilman et al.
2006/0050999 A1 3/2006 Blythe et al.
2006/0053749 A1 3/2006 Scanlan
2006/0072860 A1 4/2006 Wu
2006/0073291 A1 4/2006 Wu
2006/0076058 A1 4/2006 Rypstra
2006/0093242 A1 5/2006 Anzini et al.
2006/0104548 A1 5/2006 Schreiter
2006/0110079 A1 5/2006 Zimmerman et al.
2006/0111226 A1 5/2006 Anzini et al.
2006/0120632 A1 6/2006 Han
2006/0131328 A1 6/2006 Anderson
2006/0157140 A1 7/2006 Bergman et al.
2006/0159372 A1 7/2006 Plourde et al.
2006/0159576 A1 7/2006 Bergman et al.
2006/0165316 A1 7/2006 Cheung
2006/0177156 A1 8/2006 Owen et al.
2006/0179620 A1 8/2006 MacHacek
2006/0182371 A1 8/2006 Borchardt
2006/0193540 A1 8/2006 Borchardt
2006/0201576 A1 9/2006 Domenig
2006/0225787 A1 10/2006 Newrones et al.
2006/0228057 A1 10/2006 Newrones et al.
2006/0263497 A1 11/2006 Hoffman
2006/0283148 A1 12/2006 Zimmerman et al.
2006/0292322 A1 12/2006 Nakajima et al.
2007/0090109 A1 4/2007 Gustavsson
2007/0130733 A1 6/2007 Kasai
2007/0154118 A1 7/2007 Tilman et al.
2007/0172157 A1 7/2007 Buchman

* cited by examiner

POUCH AND AIRTIGHT RESEALABLE CLOSURE MECHANISM THEREFOR

CROSS REFERENCE TO RELATED APPLICATIONS

This application is a continuation-in-part of application Ser. No. 11/725,120, filed Mar. 16, 2007, which is incorporated by reference herein in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a resealable closure mechanism such as may be used on a thermoplastic pouch.

2. Description of the Background of the Invention

Thermoplastic pouches having one or more resealable closure mechanisms extending along an opening into an interior thereof are often used to store perishable contents, such as food. In order to keep the food stored inside the pouch fresh for an extended period, a user may press excess air out of the pouch before completely sealing the closure mechanism. Other pouches have been developed that have a separate air evacuation route so that air may be removed from the pouch after the closure mechanism has already been sealed. Some such pouches allow a vacuum to be formed inside the pouch before the pouch is sealed so as to vacuum pack the contents of the pouch.

Special resealable closure mechanisms have been used in an attempt to maintain the vacuum in the pouch over extended periods of time. Those closure mechanisms have two opposing closure elements that form an interlocking section and a sealing section in an attempt to form an airtight seal. For example, in some such closure mechanisms, one closure element has a sealing member spaced between two in-turned hooks and the other closure element has a channel defined by and between two out-turned hooks. The sealing member abuts against inside surfaces of the out-turned hooks to form a seal therewith.

In other closure mechanisms, each closure element has a sealing member disposed between two interlocking members. The sealing members press against each other when the interlocking members are appropriately interlocked to form the seal. In one closure mechanism, for example, one closure element has two spaced out-turned male hooks that interlock with two complementary in-turned female hooks. A pressing rib spaced between the out-turned male hooks is wedged into a tapered channel defined by two tightening walls spaced between the in-turned female hooks. Each tightening wall also presses against an inner surface of the adjacent out-turned male hook.

In another closure mechanism, one closure element has two interlocking bulbous members spaced between two asymmetrical arrow-shaped members projecting from one base. The other closure element has three interlocking bulbous members spaced between two interlocking groove elements projecting from another base. The closure elements resealably mate with each asymmetrical arrow-shaped member interlocked with the opposing groove element and the two interlocking bulbous members on the one closure element engaged in a tight interfering fit between successive ones of the interlocking bulbous members on the other closure element. One of the closure elements has a backing member that may be attached directly to a pouch wall, and the other closure element has a backing member that is attached at only one end to another flange element that may be attached directly to a pouch wall.

SUMMARY OF THE INVENTION

According to one aspect of the invention, an airtight resealable closure mechanism having an elongate substantially constant profile extending between a first end and a second end includes a first closure element and a second closure element. The first closure element includes a first interlocking member, a second interlocking member, and a first sealing member, each protruding from a first base member, wherein the first sealing member is disposed between the first and second interlocking members. The second closure element includes a third interlocking member, a fourth interlocking member, and a second sealing member, each protruding from a second base member, wherein the second sealing member forms a tapered channel and is disposed between the third and fourth interlocking members. The first and second interlocking members are resealably interlocked with the third and fourth interlocking members, respectively. Each of the first and second interlocking members comprises a pair of arms forming a channel-shaped female interlocking member, and each of the third and fourth interlocking members comprises an arrow-shaped male interlocking member. The first sealing member is wedged into the tapered channel of the second sealing member, whereby an airtight seal is formed. The first and second sealing members are spaced from each of the first, second, third, and fourth, interlocking members.

According to another aspect of the invention, an airtight resealable closure mechanism having an elongate substantially constant profile extending between a first end and a second end includes a first closure element and a second closure element. The first closure element includes a first interlocking member, a second interlocking member, and a first rib having a bulbous head, each protruding from a first base member, wherein the first rib is disposed between the first and second interlocking members. The second closure element includes a third interlocking member, a fourth interlocking member, and a first wall spaced from a second wall to define a channel therebetween, each protruding from a second base member, wherein the channel has substantially parallel sides and is disposed between the third and fourth interlocking members. The first and second interlocking members are resealably interlocked with the third and fourth interlocking members, respectively. Each of the second and third interlocking members comprises a pair of arms forming a channel-shaped female interlocking member, and each of the first and fourth interlocking members comprises an arrow-shaped male interlocking member. The first rib is wedged into the channel, whereby an airtight seal is formed. The first rib, the first wall, and the second wall are spaced from each of the first, second, third, and fourth, interlocking members.

According to yet another aspect of the present invention, an airtight resealable closure mechanism having an elongate substantially constant profile extending between a first end and a second end includes a first closure element and a second closure element. The first closure element includes a rib disposed between a first arrow-shaped male interlocking member and a second arrow-shaped male interlocking member, each of the first and second interlocking members and the rib protruding from one side of a first base member. The second closure element includes first and second walls disposed between a third arrow-shaped male interlocking member and a fourth arrow-shaped male interlocking member, each of the third and fourth interlocking members and the first and second walls protruding from one side of a second base member. The first interlocking member is resealably interlocked with the third interlocking member and the second interlocking member is resealably interlocked with the fourth interlocking member. The rib is wedged against the first and second walls, whereby an airtight seal is formed between the rib and the first and second walls.

BRIEF DESCRIPTION OF THE DRAWINGS

Other aspects and advantages of the present invention will become apparent upon consideration of the following detailed description, wherein similar structures have the same reference numerals throughout.

DETAILED DESCRIPTION

Figure 1:
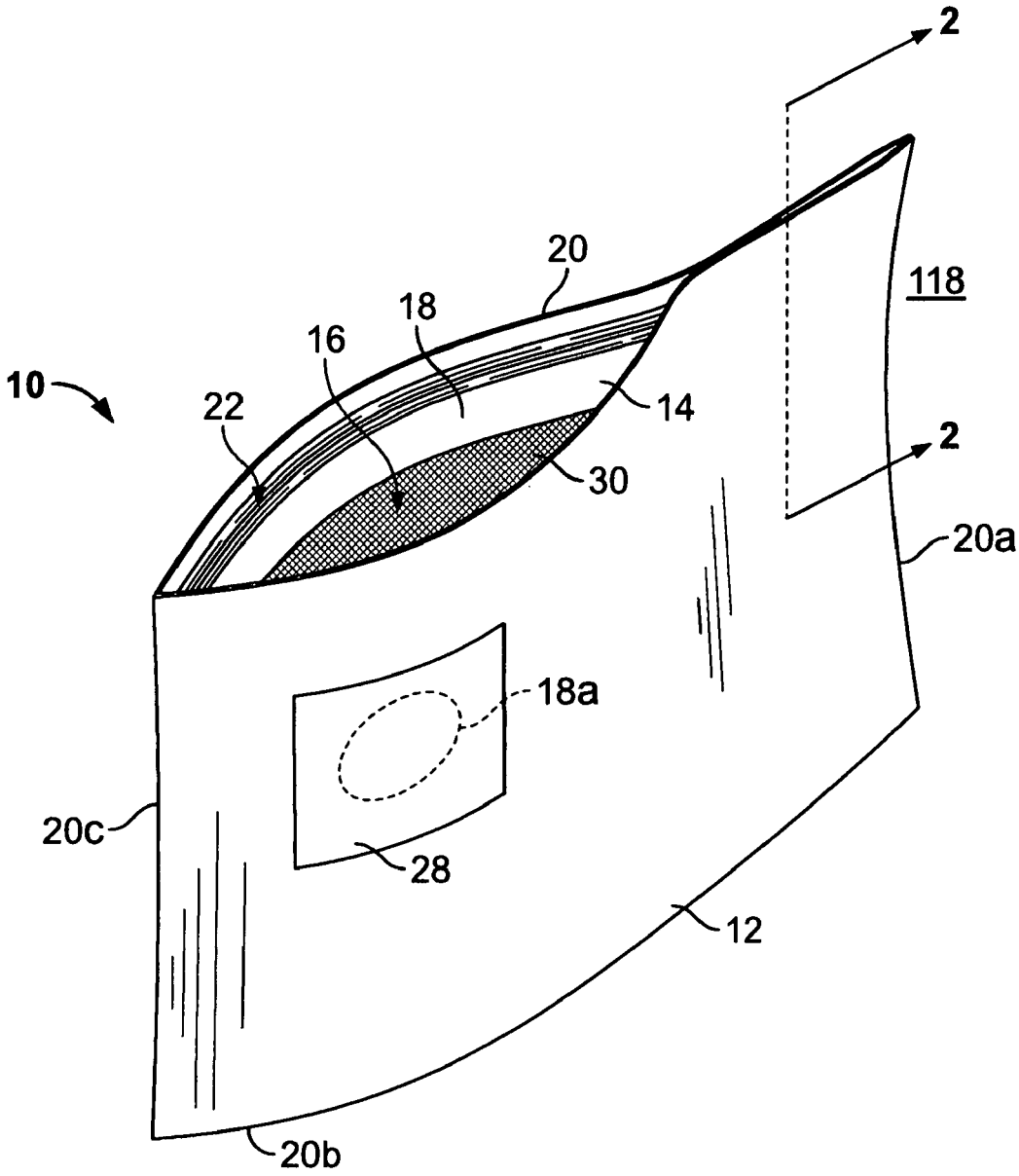
FIG. 1 is an isometric view of a pouch and an airtight closure mechanism according to one aspect of the present invention.
Figure 2:
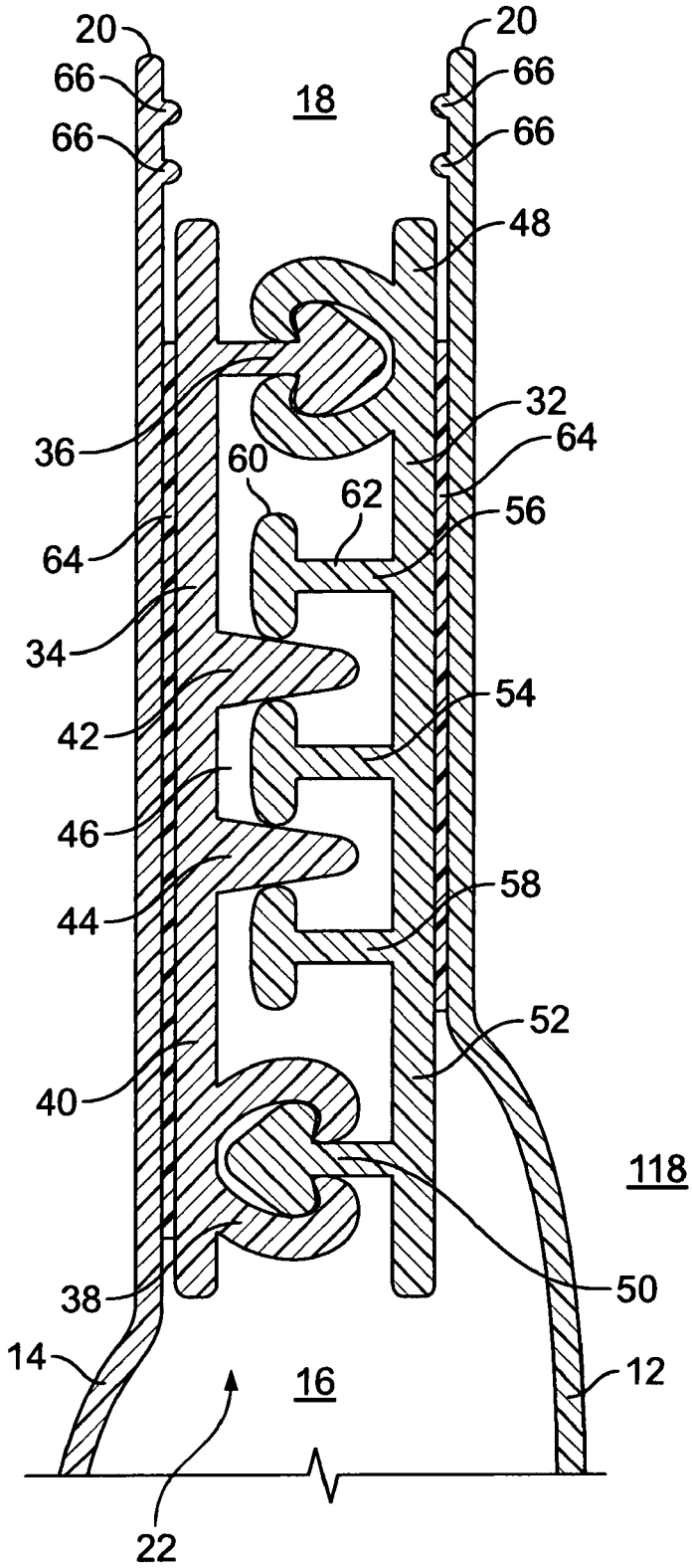
FIG. 2 is a partial cross-sectional view along the line 2-2 of FIG. 1 with portions behind the plane of the cross-section omitted for clarity.

As seen in FIGS. 1 and 2, a resealable pouch 10 includes a first sidewall 12 and a second sidewall 14 that are connected, such as by folding, heat seal, and/or adhesive, along three peripheral edges 20*a*, 20*b*, and 20*c* to define a sealable interior space 16 therebetween, and an opening 18 is defined along a top edge 20 where the first and second sidewalls are not connected so as to allow access to the interior space. A resealable elongate closure mechanism 22 extends along the first and second sidewalls 12, 14 near the opening 18 between the peripheral edge 20*a* and the peripheral edge 20*c* of the pouch 10 to allow the opening to be repeatedly sealed and unsealed, thereby closing and opening, respectively, the opening.

When occluded, the closure mechanism 22 provides an air-tight seal such that a vacuum may be maintained in the pouch interior 16 for a desired period of time, such as days, months, or years, when the closure mechanism is sealed fully across the opening 18. In one embodiment, the pouch 10 may include a second opening 18*a* through one of the sidewalls 12, 14 covered by a valve 28, such as a check or one-way valve, to allow air to be evacuated from the pouch interior 16 and maintain a vacuum when the closure mechanism 22 has been sealed. As shown in FIG. 1, the valve 28 may be disposed on the first sidewall 12 spaced from the closure mechanism 22. The valve 28 provides a fluid path with fluid communication between the pouch interior 16 and an exterior 118 of the pouch. Illustrative valves useful in the present invention include those disclosed in, for example, Newrones et al. U.S. Patent application publication No. 2006/0228057. Other valves useful in the present invention include those disclosed in, for example, Ser. Nos. 11/818,592, 11/818/586 and 11/818,591, each filed on the same day as the present application.

Although not shown, in some embodiments an evacuation pump or device may be used to evacuate fluid from the pouch 10 through, for example, the valve 28 disposed in one of the sidewalls 12, 14, or in or through the closure mechanism 22 or in one of the peripheral edges 20*a*-20*c* of the pouch. Illustrative evacuation pumps or devices useful in the present invention include those disclosed in, for example, Ser. No. 11/818,703, filed on the same day as the present application.

The pouch 10 may include relief on or along an interior surface of one or both of the first and second sidewalls 12, 14 to provide air flow channels 30 between the sidewalls when a vacuum is being drawn through the check valve 28. In this manner, the pouch 10 provides a complete evacuable system within which food, for example, may be stored in a reusable vacuum pouch. One or both sidewalls, such as the second sidewall 14, may also be embossed or otherwise textured with a pattern, such as a diamond pattern, on one or both surfaces spaced between the bottom edge 20*b* and the closure mechanism 22 and including a smooth area adjacent the bottom edge and the top edge 20, or a separate textured and embossed patterned wall may be used to provide additional flow channels (not shown) within the pouch interior 16. Illustrative flow channels useful in the present invention include those disclosed in Zimmerman et al. U.S. Patent Application Publication No. 2005/0286808 and Tilman et al. U.S. Patent Application Publication No 2006/0048483. Other flow channels useful in the present invention include those disclosed in, for example, Ser. No. 11/818,584, filed on the same day as the present application.

As seen in FIG. 2, the closure mechanism 22 includes an interlocking closure element 32 that releasably interlocks and seals with an opposing interlocking closure element 34. Each interlocking closure element 32, 34 has a substantially constant elongate cross-sectional profile that extends longitudinally between the peripheral edge 20*c* and the peripheral edge 20*a* of the pouch 10 to form a continuous seal therealong when fully interlocked with the opposing closure element. In one embodiment, closure element 32 is disposed along the first sidewall 12 and the closure element 34 is disposed along the second sidewall 14 opposite the first closure element so as to resealably interlock along an entire length thereof.

The interlocking closure element 34 has an elongate closure profile including a sealing section spaced between two interlocking members 36, 38, each projecting from a common side of a base member 40. In one embodiment, the interlocking member 36 has an arrow-shaped male interlocking profile, and the interlocking member 38 has a channel-shaped female interlocking profile. The arrow-shaped male interlocking profile 36 includes a shaft extending outwardly from the base member 40 and a symmetrical head with barbs extending from opposite sides of a distal end of the shaft spaced from the base member. The channel-shaped female interlocking profile 38 includes two spaced arms extending from the backing member 40, each arm having an in-turned hook at a distal end thereof, to form a channel therebetween. The sealing section of the closure element 34 includes a sealing wall 42 and a sealing wall 44 spaced apart and projecting outwardly from the base member 40. The sealing walls 42, 44 in one embodiment are tapered, having a tip that is narrower than a base, thereby forming a tapered generally V-shaped channel 46 therebetween. In one embodiment, the sealing walls 42, 44 and the male and female interlocking profiles 36, 38 are all approximately the same height from the base member 40.

The interlocking closure element 32 has an elongate second closure profile including a sealing section spaced between two interlocking members 48, 50, each projecting from a common side of a backing member 52. In one embodiment, the interlocking member 48 has a channel-shaped female interlocking profile, and the interlocking member 50 has an arrow-shaped male profile, complementary with the respective male and female interlocking profiles 36, 38, respectively, of the closure element 34. The sealing section of the closure element 32 includes at least one sealing rib that wedges into the tapered channel 46 between the opposing sealing walls 42, 44. In one embodiment, the sealing section includes a first sealing rib 54 disposed between a second sealing rib 56 and a third sealing rib 58. Each sealing rib 54, 56, 58 has a bulbous head 60, such as a cross member, spaced from the base 52 proximate a distal end of a wall 62, which projects from the base 52. In one embodiment, each sealing rib 54, 56, 58 has a T-shaped cross-section. In other embodiments, the bulbous head 60 may have other shapes that project laterally from the wall 62, such as rounded, asymmetrical, slanted, or multiple projections, for example. The first and second interlocking closure elements 32, 34 may include closure profiles as described previously herein. However, the configuration and geometry of the closure elements 32, 34 and closure profiles as disclosed herein may vary.

In a further embodiment, one or both of the closure elements 32, 34 may include one or more textured portions, such as a bump or crosswise groove in one or more of the interlocking members 36, 38, 48, 50 in order to provide a tactile sensation, such as a series of clicks, as a user draws the fingers along the closure mechanism to seal the closure elements across the opening 18. In another embodiment, all of the interlocking members 36, 38, 48, 50 include textured portions along the length of the profile to provide tactile and/or audible sensations when closing the closure mechanism 22. Further, in some embodiments, a sealing material such as a polyolefin material or a caulking composition such as silicone grease may be disposed on or in the closure profiles or closure elements 32, 34 to fill in any gaps or spaces therein when occluded. The ends of the closure profiles or closure elements 32, 34 may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, and Ser. Nos. 11/818,585 and 11/818,586, each filed on the same day as the present application. It is further appreciated that the closure profiles or closure elements disclosed herein may be operated by hand, or a slider (not shown) may be used to assist in occluding and de-occluding the closure profiles and closure elements.

In a sealed state, the male interlocking profile 50 is interlocked with the female interlocking profile 38, and the female interlocking profile 48 is interlocked with the male interlocking profile 36. The bulbous head 60 of the sealing rib 54 is wedged tightly into the tapered channel 46 against the sealing walls 42, 44. The sealing wall 42 is wedged tightly between and against the bulbous heads 60 of the sealing rib 54 and the sealing rib 56, and the sealing wall 44 is wedged tightly between and against the bulbous heads 60 of the sealing rib 54 and the sealing rib 58. Preferably, the geometry of the sealing walls 42, 44 and the sealing ribs 54, 56, 58 is such that, when the interlocking profiles 36, 38, 48, 50 are occluded together in the sealed state, the distal ends of the sealing walls are spaced from the backing member 52 and the bulbous heads 60 are spaced from the backing member 40, thereby ensuring four air tight seals across the closure elements 32, 34 between the interlocking profiles 36, 48 and 38, 50. Further, the sealing sections are spaced from each interlocking member 36, 38, 48, 50, which provides a sealing section that forms an air tight seal independently of the interlocking members. Of course, more or fewer sealing walls and sealing ribs may be used in other embodiments to form more or fewer air tight seals across the closure elements.

In order to develop differential opening and closing forces, one of the closure elements may be secured continuously to the respective sidewall along the entire profile of the base member, and the other closure element may be secured partially to the respective sidewall along only a portion of the profile. For example, in one embodiment, the closure element 34 is connected with the second sidewall 14 continuously between the interlocking member 36 and the interlocking member 38. The closure element 32 is connected with the first sidewall 12 continuously between the interlocking member 48 and an interior side of the sealing rib 58, and an interior end of the closure element 32 is unconnected with the first sidewall 12 between the interior end of the base 52 and the interior side of the sealing rib 58. In this manner, differential opening and closing forces may be developed because the interior end and interlocking profile 50 of the base 52 of at least the closure element 32 is allowed to hinge away from the first sidewall 12, thereby minimizing an opening force caused by the contents pushing outwardly against the first and second sidewalls 12, 14. In other embodiments, the interior end of either or both closure elements 32, 34 may be unconnected with the respective sidewall 12 or 14, or the interior end of both closure elements may be connected with the respective sidewall.

The closure elements 32, 34 may be connected with the respective first and second sidewalls 12, 14 by many means, such as with adhesives or heat or ultrasonic welding. In one embodiment, the closure elements 32, 34 are connected with the respective sidewalls 12, 14 using an intermediate layer 64 of connecting material, such as thermoplastic weld material, disposed between and connecting the base member 40, 52 of the closure element with the respective sidewall 14, 12. In this embodiment, a hot layer of thermoplastic weld material 64 applied between each closure element 32, 34 and the respective sidewall 12, 14 melts and attaches to both the sidewall and the base member, thereby forming a thermoplastic weld therebetween, which in some embodiments may provide a good continuous air tight seal between each sidewall and the respective closure element.

In one embodiment, the top edge 20 of one or both of the first and second sidewalls extends upwardly beyond an exterior end of the respective closure element 32, 34. One or more protuberances, for example, grip ridges 66, project from an interior side of one both of the sidewalls 12, 14 between the top edge 20 and the respective closure element 32, 34 to provide additional finger traction in a convenient area for a user to grip for opening the closure mechanism 22.

In one embodiment, the first and second sidewalls 12, 14 and/or the closure mechanism 22 are formed from thermoplastic resins by known extrusion methods. For example, the sidewalls 12, 14 may be independently extruded of thermoplastic material as a single continuous or multi-ply web, and the closure mechanism 22 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, inner surfaces of the respective sidewalls 12, 14 or a portion or area thereof may, for example, be composed of a polyolefin plastomer such as an AFFINITY™ resin manufactured by Dow Plastics. Such portions or areas include, for example, the area of one or both of the sidewalls 12, 14 proximate and parallel to the closure mechanism 22 to provide an additional cohesive seal between the sidewalls when the pouch 10 is evacuated of fluid. One or more of the sidewalls 12, 14 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 12, 14. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure mechanism 22 may be extruded primarily of molten PE with various amounts of slip component, colorant, and talc additives in a separate process. The fully formed closure mechanism 22 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

The fully formed closure elements 32, 34 may be attached along opposite edges of one side of the web by placing or extruding a strip of molten thermoplastic weld material 64 onto the web along or adjacent to each edge of the web and immediately placing a closure element 32, 34 onto each strip of molten thermoplastic weld material. The thermoplastic weld material 64 may then be allowed to cool, the web folded together between the opposite edges to place the closure elements 32, 34 in opposing resealable relation, and the web severed transverse to the web direction into discrete pouches, in a manner well known in the art, to form the pouch 10. According to another embodiment, the web, intermediate layer of connecting material 64, and the closure elements 32, 34 may be extruded together simultaneously, and subsequently cooled, folded, and cut. If used, the check valve 28 may be formed on and/or attached to the web prior to folding or after folding.

The resealable pouch described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Of course, various details shown in FIGS. 1 and 2 may be modified within the spirit of the present invention. For example, the specific orientation of the closure elements 32, 34 with respect to the interior 16 may be altered from the orientation shown in the drawings, such that, for example, the male interlocking profile 36 and the female interlocking profile 48 may be disposed on the interior side 16 of the sealing sections. In addition, the location and/or use of the check valve 28 and the air flow channels 30 may be modified as desired.

Figure 3:
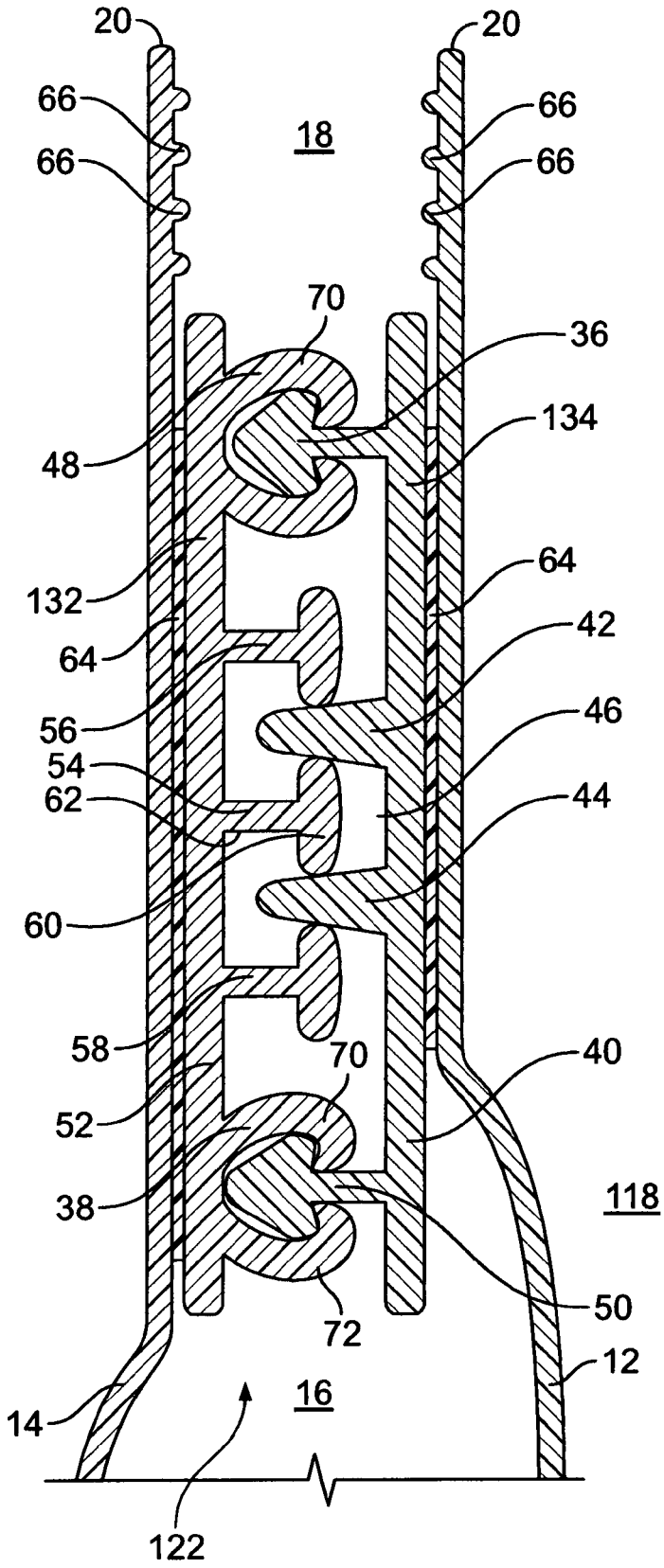
FIG. 3 is a partial cross-sectional view similar to the view of FIG. 2 of an airtight resealable closure mechanism according to another embodiment.

Referring to FIG. 3, another embodiment of an airtight closure mechanism 122 includes closure elements 132 and 134, which are similar to the closure elements 32, 34, but with the following differences. The closure element 132 includes the sealing ribs 54, 56, 58 spaced between the interlocking members 38 and 48 projecting from the interior side of the base member 52. Further, the closure element 134 includes the sealing walls 42, 44 spaced between the interlocking members 36 and 50 projecting from the interior side of the base member 40. Spacing the sealing sections comprising the ribs 54, 56, 58 and the walls 42, 44 from the interlocking members 36, 38, 48, 50 may generally provide a high integrity seal that is independent of the interlocking sections. Each interlocking member 36, 50 has an arrow-shaped male interlocking profile, and each interlocking member 38, 48 has a channel-shaped female profile including a pair of arms 70, 72 that interlockingly engage the opposing interlocking member 36 or 50. Disposing both of the interlocking members having a female profile 38, 48 on a common closure element, for example, 132, and disposing both of the male interlocking members 36, 50 on an opposing common closure element, for example, 134, may generally contribute to ease of manufacture of the closure elements.

Each closure element 132 and 134 is attached by an intermediate layer 64 to the respective first or second sidewall 12 or 14 so as to create differential opening force in a similar manner as described previously herein. For example, the closure element 132 is fully attached to the second sidewall 14 with the intermediate layer 64 extending completely between the interlocking members 38 and 48, whereas the closure element 134 is only partially attached to the first sidewall 12 such that the interlocking member 50 and the sealing rib 58 may deflect away from the first sidewall and the interlocking member 36 and sealing ribs 54 and 56 are not able to deflect away from the first sidewall. The remaining features of the closure mechanism 122 are substantially similar to the closure mechanism 22 as previously described herein. In another embodiment, the closure element 132 may be attached to the first sidewall 12 and the closure element 134 may be attached to the second sidewall 14.

Figure 4:
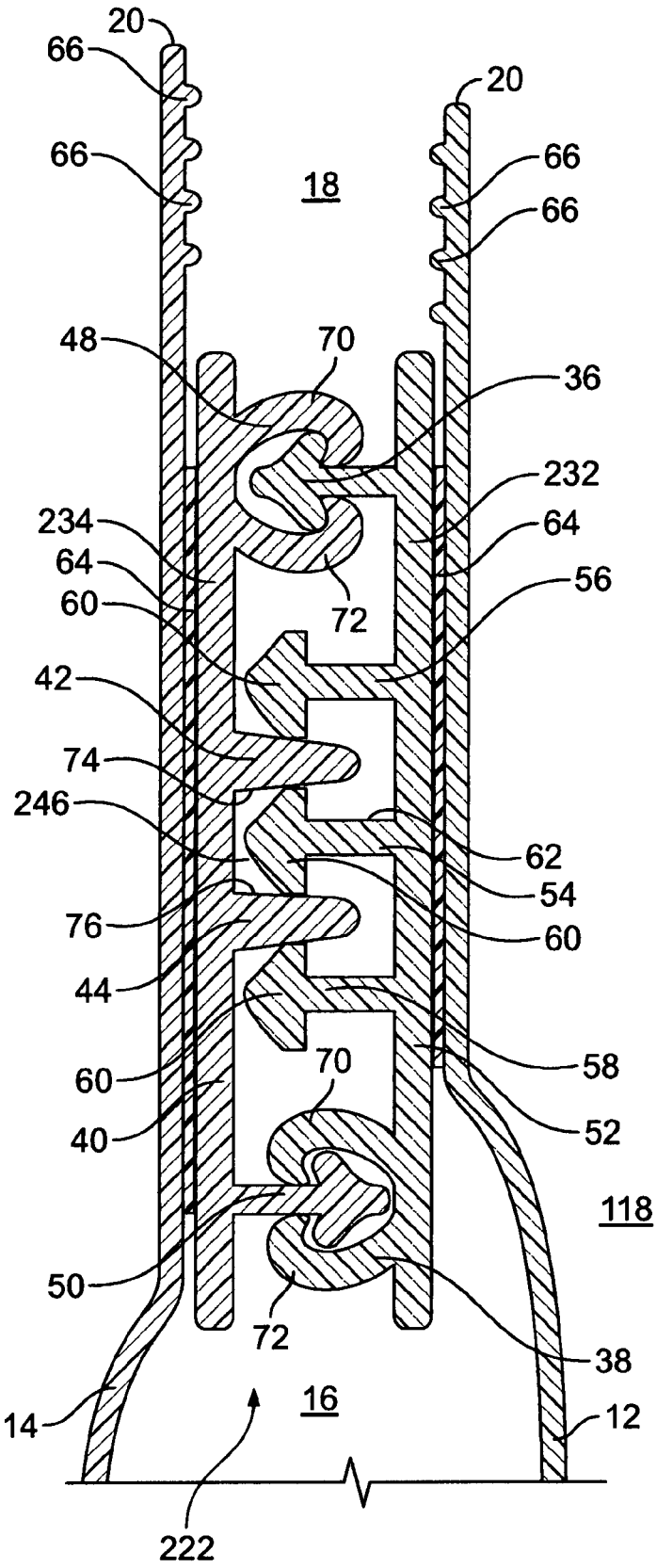
FIG. 4 is a partial cross-sectional view similar to the view of FIG. 2 of an airtight resealable closure mechanism according to still another embodiment.

Referring now to FIG. 4, a further embodiment of an airtight closure mechanism 222 includes closure elements 232 and 234, which are similar to the closure elements 132 and 134, respectively, but with the following differences. The closure element 232 includes sealing ribs 54, 56, 58 spaced between interlocking members 36 and 38 projecting from the interior side of the base member 52. Further, the closure element 234 includes sealing walls 42, 44 spaced between interlocking members 48 and 50 projecting from the interior side of the base member 40. The bulbous heads 60 on the sealing ribs 54, 56, 58 are arrow-shaped. The sealing walls 42, 44 have substantially parallel facing inner surfaces 74, 76, respectively, thereby defining an un-tapered channel 246 therebetween. The arrow-shaped bulbous heads 60 of the sealing ribs 54, 56, 58 may generally provide a high integrity seal requiring a smaller closing force to engage than the T-shaped bulbous heads of the embodiments described previously herein. Each closure element 232, 234 is attached to the respective first or second sidewall 12, 14 by an intermediate layer 64 so as to create a differential opening force in a similar manner as previously described herein. All other features of the closure mechanism 222 are substantially similar to the closure mechanism 122 as previously described herein. In another embodiment, the closure element 232 may be attached to the second sidewall 14 and the closure element 234 may be attached to the first sidewall 12.

Figure 5:
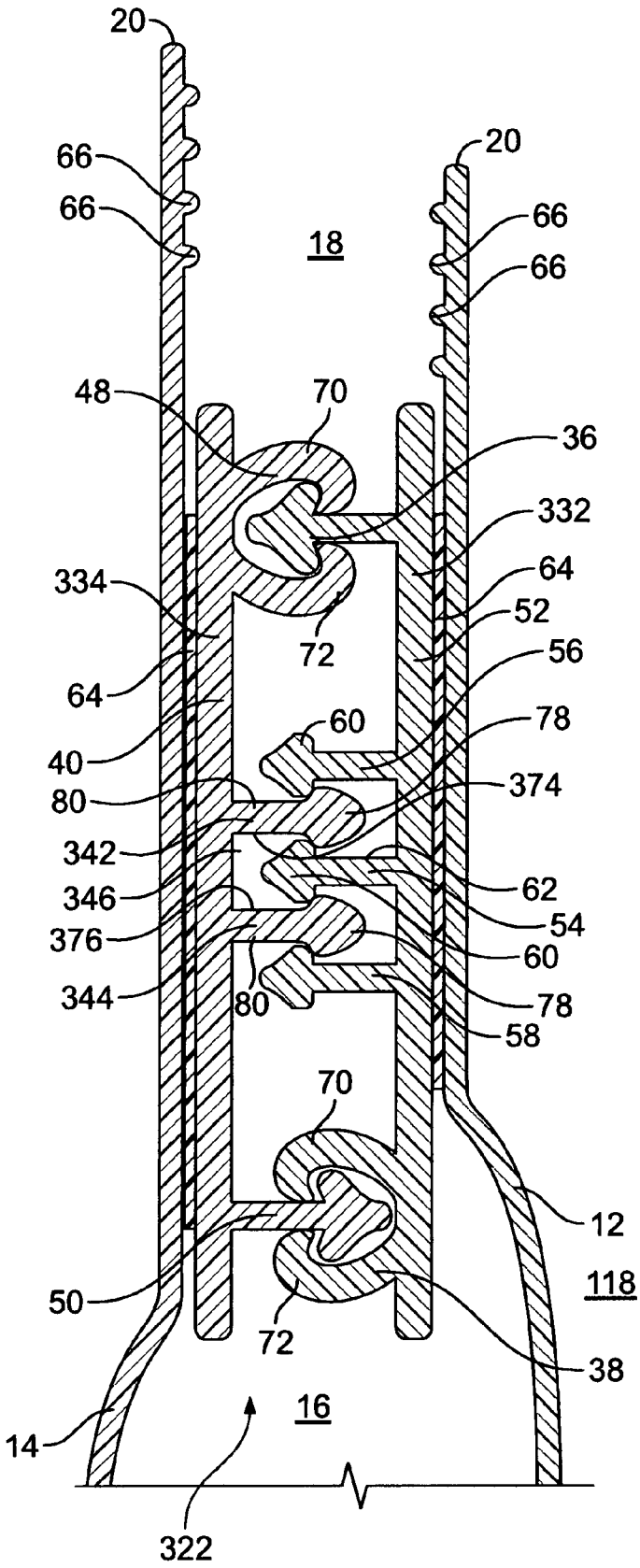
FIG. 5 is a partial cross-sectional view similar to the view of FIG. 2 of an airtight resealable closure mechanism of yet another embodiment.

Referring now to FIG. 5, yet another embodiment of an airtight closure mechanism 322 includes closure elements 332 and 334, which are similar to the closure elements 232 and 234, respectively, but with the following differences. The closure element 334 includes sealing walls 342, 344 spaced between the interlocking members 48 and 50 projecting from the interior side of the base member 40. Each sealing wall 342, 344 has a bulbous head 78 spaced from the base member 40 proximate a distal end of a wall 80, which projects from the base 40. In one embodiment, the wall 80 has substantially parallel sides and the bulbous head 78 is generally arrow-shaped. In other embodiments, the walls 80 may be tapered and the bulbous heads 78 may have other shapes that project laterally from the wall 80, such as rounded, asymmetrical, slanted, or having multiple projections. The sealing walls 342, 344 define a channel 346 therebetween, wherein the channel 346 may be tapered or may have substantially parallel opposing side surfaces 374, 376. The addition of the bulbous heads 78 to the sealing walls 342, 344 may generally enhance the likelihood of a high integrity seal when engaged with the arrow-shaped bulbous heads 60 of the sealing ribs 54, 56, 58. The bulbous heads 78 may also provide an additional interlock between the closure elements 332, 334 to supplement the interlocking strength of the interlocking members 36, 38, 48, 50. Each closure element 332, 334 is attached to the respective first or second sidewall 12, 14 by an intermediate layer 64 so as to create a differential opening force in a similar manner as previously described herein. All other features of the closure mechanism 322 are substantially similar to the closure mechanism 222 as previously described herein. In another embodiment, the closure element 332 may be attached to the second sidewall 14 and the closure element 334 may be attached to the first sidewall 12.

Figure 6:
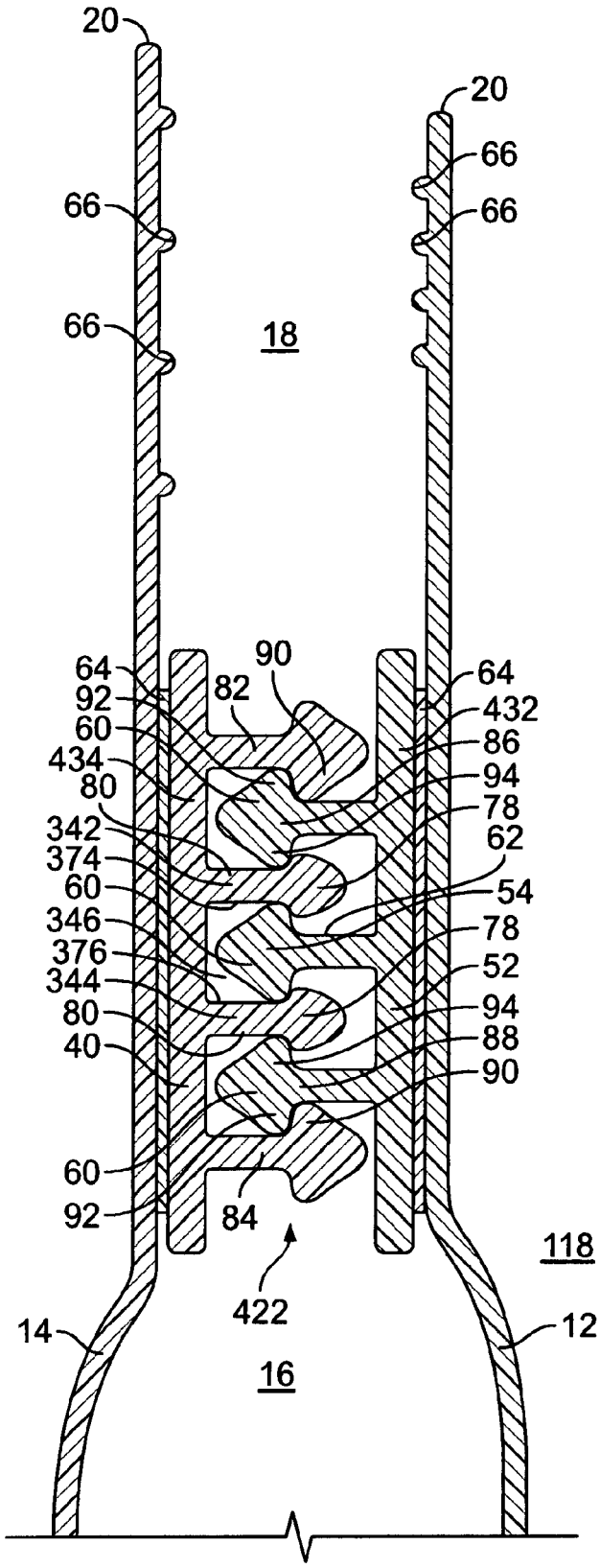
FIG. 6 is a partial cross-sectional view similar to the view of FIG. 2 of an airtight resealable closure mechanism according to a further embodiment.

Referring now to FIG. 6, a still further embodiment of an airtight closure mechanism 422 includes closure elements 432 and 434, which are similar to the closure elements 332 and 334, respectively, but with the following differences. The sealing sections of the closure elements 432 and 434 are immediately adjacent the interlocking sections. The closure element 434 includes the sealing walls 342, 344 disposed between interlocking members 82 and 84 projecting from the interior side of the base member 40. Further, the closure element 432 includes the sealing rib 54 disposed between interlocking members 86 and 88 projecting from the interior side of the base member 52. Each of the interlocking members 82, 84, 86, 88 has a male interlocking profile, which in one embodiment includes two barbs projecting from opposite sides of a shaft forming an arrow shape. The interlocking member 82 interlocks with the interlocking member 86, and the interlocking member 84 interlocks with the interlocking member 88. A barb 90 extending from a side facing the sealing section of a distal end of the shaft of each male interlocking member 82, 84 engages and interlocks with a barb 92 extending from a side facing away from the sealing section of a distal end of the shaft of each corresponding male interlocking profile member 86, 88. Further, a barb 94 extending from a side facing the sealing section of the distal end of the shaft of each male interlocking member 86, 88 makes contact with each sealing wall 342, 344, respectively. Providing this embodiment with all male interlocking members 82, 84, 86, 88 may generally provide for ease of manufacture by requiring extrusion of only male profiles. Further, disposing the interlocking members 82, 84, 86, 88 immediately adjacent to the sealing sections of the closure elements 432 and 434 may provide a closure mechanism 422 that is more rigid overall and thereby less resistant to deformation.

Each closure element 432, 434 is attached to the respective first or second sidewall 12, 14 by an intermediate layer 64 so as to create a differential opening force in a similar manner as previously described herein. For example, the intermediate layer 64 extends behind all the interlocking members 82, 84 and sealing walls 342, 344 on the closure element 434, and the intermediate layer extends behind only the sealing rib 54, the interlocking member 86, and an upper portion of the base member 52 on the closure element 432. Other portions of the closure mechanism 422 shown in FIG. 6 are substantially similar to the corresponding portions of the closure mechanism 322 as previously described herein. In another embodiment, the closure element 432 may be attached to the second sidewall 14 and the closure element 434 may be attached to the first sidewall 12.

Figure 7:
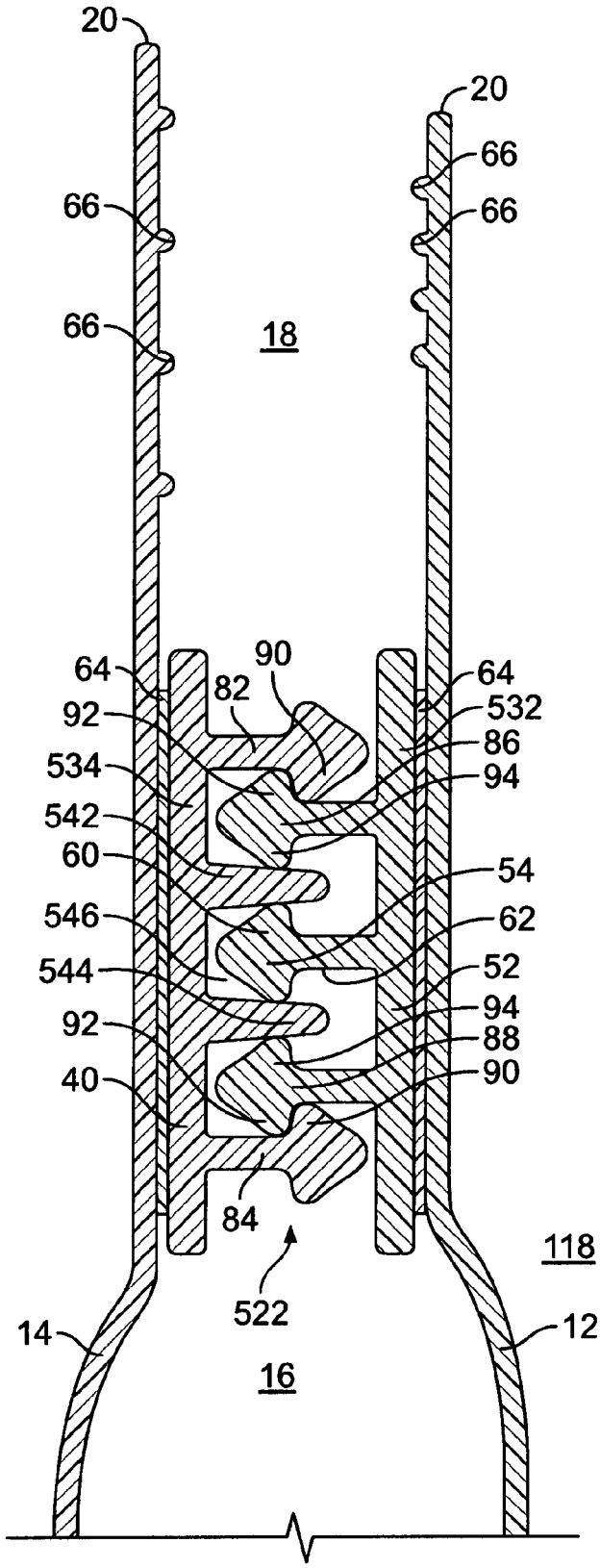
FIG. 7 is a partial cross-sectional view similar to the view of FIG. 2 of an airtight resealable closure mechanism of a still further embodiment.

Referring now to FIG. 7, yet a further embodiment of an airtight closure mechanism 522 includes closure elements 532 and 534, which are similar to the closure elements 432 and 434, respectively, but with the following differences. The closure element 534 includes sealing walls 542, 544 disposed between the interlocking members 82 and 84 projecting from the interior side of the base member 40. In one embodiment, the sealing walls 542, 544 have substantially parallel opposing sides that define an un-tapered channel 546 therebetween, similar to the same features in the embodiment of FIG. 4. In another embodiment, the sealing walls 542, 544 have tapered opposing sides that define a tapered channel 546 therebetween, which is narrower near the base 40 and wider at a distal end of the sealing walls. The barb 94 extending from the side facing the sealing section of the distal end of the shaft of each male interlocking member 86, 88 contacts each sealing wall 542, 544, respectively. In one embodiment, the side of each sealing wall 542, 544 is tapered toward the distal end, which causes the sealing wall to wedge against the respective barb 94 when the closure elements 532, 534 are interlocked together. Disposing the interlocking members 86, 88 so that occlusion of the closure mechanism 522 forces the interlocking members 86 and 88 inwardly against walls 542 and 544, respectively, may provide a closure mechanism 522 having a high integrity seal that is more rigid overall compared to embodiments having sealing sections spaced from interlocking sections.

Each closure element 532, 534 is attached to the respective first or second sidewall 12, 14 by an intermediate layer 64 so as to create a differential opening force in a similar manner as previously described herein. Other portions of the closure mechanism 522 are substantially similar to the corresponding portions of the closure mechanism 422 as previously described herein. In another embodiment, the closure element 532 may be attached to the second sidewall 14 and the closure element 534 may be attached to the first sidewall 12.

In further embodiments, more or fewer sealing walls and sealing ribs may be used in each embodiment described herein in order to form more or fewer air tight seals across the closure elements. Although various specific embodiments have been shown and described herein, this specification explicitly includes all possible permutations of combinations of the features, structures, and components of all the embodiments shown and described.

INDUSTRIAL APPLICABILITY

An airtight resealable closure mechanism for a pouch is presented that may be used to pack and store perishable items contained therein in an air-free or vacuum environment. The closure mechanism includes a sealing section that may be separate from an interlocking section and may therefore provide a more secure air tight seal. Clearly, many other and varied uses of the pouch and closure mechanism disclosed herein are also possible.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. An airtight resealable closure mechanism having an elongate substantially constant profile extending between a first end and a second end, the profile comprising:

a first closure element having a first interlocking member, a second interlocking member, and a first sealing member, each protruding from a first base member, wherein the first sealing member is disposed between the first and second interlocking members; and a second closure element having a third interlocking member, a fourth interlocking member, and a second sealing member, each protruding from a second base member, wherein the second sealing member forms a generally V-shaped tapered channel and is disposed between the third and fourth interlocking members;

wherein the first interlocking member is resealably interlocked with the third interlocking member and the second interlocking member is resealably interlocked with the fourth interlocking member;

wherein each of the first and second interlocking members comprises a pair of arms forming a channel-shaped female interlocking member, and wherein each of the third and fourth interlocking members comprises an arrow-shaped male interlocking member;

wherein the first sealing member is wedged into the generally V-shaped tapered channel of the second sealing member, whereby an airtight seal is formed; and wherein the first and second sealing members are spaced from each of the first, second, third, and fourth, interlocking members.

2. The closure mechanism of claim 1, wherein the first sealing member comprises a first rib disposed between a second rib and a third rib, wherein each of the first, second, and third ribs is T-shaped, and wherein the first rib is wedged within the generally V-shaped tapered channel.

3. The closure mechanism of claim 2, wherein the second sealing member comprises a first wall spaced from a second wall defining the generally V-shaped tapered channel therebetween, wherein the first wall is disposed between the first rib and the second rib, and the second wall is disposed between the first rib and the third rib.

4. The closure mechanism of claim 3, wherein the first wall is wedged between the first and second ribs and the second wall is wedged between the first and third ribs.

5. The closure mechanism of claim 1, wherein the first closure element is continuously connected to a first sidewall between the first interlocking member and the second interlocking member, and wherein the second closure element is continuously connected to a second sidewall between the third interlocking member and the second sealing member and not connected to the second sidewall proximate the fourth interlocking member, and one or more of the first, second, third, and fourth interlocking members includes a textured portion along the length of each member to provide tactile and/or audible sensations when the closure mechanism is occluded.

* * * * *